United States Patent [19]

Hosooka

[11] 4,253,688

[45] Mar. 3, 1981

[54] LOCKING MECHANISM FOR DOUBLE-SLIDING SASHES

[75] Inventor: Syuichi Hosooka, Namerikawa, Japan

[73] Assignee: Yoshida Kogyo K.K., Tokyo, Japan

[21] Appl. No.: 61,014

[22] Filed: Jul. 26, 1979

[30] Foreign Application Priority Data

Jul. 26, 1978 [JP] Japan ..... 53-102560[U]

[51] Int. Cl.[3] ..... E05C 11/00

[52] U.S. Cl. ..... 292/52; 292/DIG. 46; 292/241; 292/341.17

[58] Field of Search ..... 292/48, 52, 48, 341.17, 292/241, 242, DIG. 21, 44, 53

[56] References Cited

U.S. PATENT DOCUMENTS

| | | | |
|---|---|---|---|
| 388,229 | 8/1888 | Thode | 292/DIG. 21 |
| 1,247,052 | 11/1917 | Wilson | 292/DIG. 21 |
| 3,338,611 | 8/1967 | Bertovich, Jr. et al. | 292/52 X |
| 3,785,684 | 1/1974 | Nakanishi | 292/241 |
| 4,095,829 | 6/1978 | Van Klompenburg | 292/241 |

*Primary Examiner*—Richard E. Moore

*Attorney, Agent, or Firm*—Hill, Van Santen, Steadman, Chiara & Simpson

[57] ABSTRACT

A locking mechanism for double-sliding sashes is provided to fasten inside and outside sashes and lock the fastened sashes to a window frame by a single operation using a handle. The mechanism comprises a crescent sash fastener composed of a fastening member and a receptacle member. The receptacle member is revolvable by being pushed by a projection of the fastening member which is revolved by a handle to fasten them together. The revolving movement of the receptacle member is converted into a vertical movement of a driving rod provided in a meeting stile of the outside sash. The vertical movement of the driving rod rotates locking levers which are linked to the rod at the upper and lower ends thereof to push the window frame in a firmly secured condition.

3 Claims, 6 Drawing Figures

LOCKING MECHANISM FOR DOUBLE-SLIDING SASHES

BACKGROUND OF THE INVENTION

This invention relates to a mechanism for locking or fastening double-sliding doors or a dual sash window assembly in which a pair of sliding sashes are mounted in paralled and closely spaced planes within a supporting frame so as to obtain relative, horizontal sliding or rolling movements.

Many buildings are provided with double-sliding doors and a dual sash window assembly and, when the double-sliding doors or double-sliding window sashes are locked in the closed state, it has been most usual to use a crescent sash lock provided on the meeting stiles of both door sashes or window sashes. Namely, a crescent-like member pivotally mounted on the lateral face of the meeting stile of the inside sash is pivotally revolved by hand, so that the forward end of the crescent member comes into engagement with the hooked part of the receptacle plate which is mounted on the inward face of the meeting stile of the outside sash, and the inside sash and the outside sash are firmly fastened to each other.

One of the problems in the above crescent sash lock is that, although the inside and outside sashes are fastened to each other, the fastened sashes themselves are not fixedly secured in relation to the door frame or window frame and, as a result, rattling of the sashes, draught of air and leakage of rain water cannot be prevented, especially in stormy weather.

In order to solve the problem, there have been proposed several means, apart from the use of the crescent sash locks, for pushing up the sashes to the door frame or window frame so as to secure the sashes fixedly. Such push-up means of the sashes, however, has to be handled by an operation separate from the operation of the crescent sash lock and, therefore, it has become desirous to provide a locking mechanism for double-sliding doors and window sashes with which the fastening of the sashes to each other and the fixing of the thus fastened sashes to the frame can be effected simultaneously in a single operation.

SUMMARY OF THE INVENTION

An object of the present invention is to provide a mechanism for locking double-sliding door sashes or window sashes with which both of the sashes can be fastened to each other and, simultaneously, the fastened sashes are pushed up to the door frame or window frame in a single operation so that the doors or windows can be locked conveniently with increased security.

The mechanism of the present invention comprises:

(a) a crescent fastening member mounted on the lateral face of the meeting stile of the inside sash in a manner capable of being revolved pivotally by a handle, the crescent fastening member being provided with a pusher projection in the radial direction opposite to the crescent of the crescent fastening member, (b) a receptacle member mounted on the inward face of the meeting stile of the outside sash in a manner capable of being revolved pivotally, the receptacle member being provided with a hooked part bent inwardly and coming into engagement with the crescent of the crescent fastening member when the crescent fastening member is pivotally revolved and being provided with a contact projection coming into contact with the pusher projection of the crescent fastening member and pushed by the contact projection when the crescent fastening member is pivotally revolved so that the receptacle member is pivotally revolved, (c) a driving rod provided in the meeting stile of the outside sash and linked with the receptacle member and moved up and down by the revolving of the receptacle member, and (d) locking levers each being linked with the driving rod at the upper or lower end thereof and revolvable by the up-and-down movement of the driving rod to push the side walls of the supporting frame each at one end thereof or come apart from the side walls of the supporting frame.

BRIEF DESCRIPTION OF THE DRAWINGS

The present invention will be described by way of a preferred example with reference to the accompanying drawings, wherein.

DETAILED DESCRIPTION OF THE PREFERRED EMBODIMENTS

Figure 1:
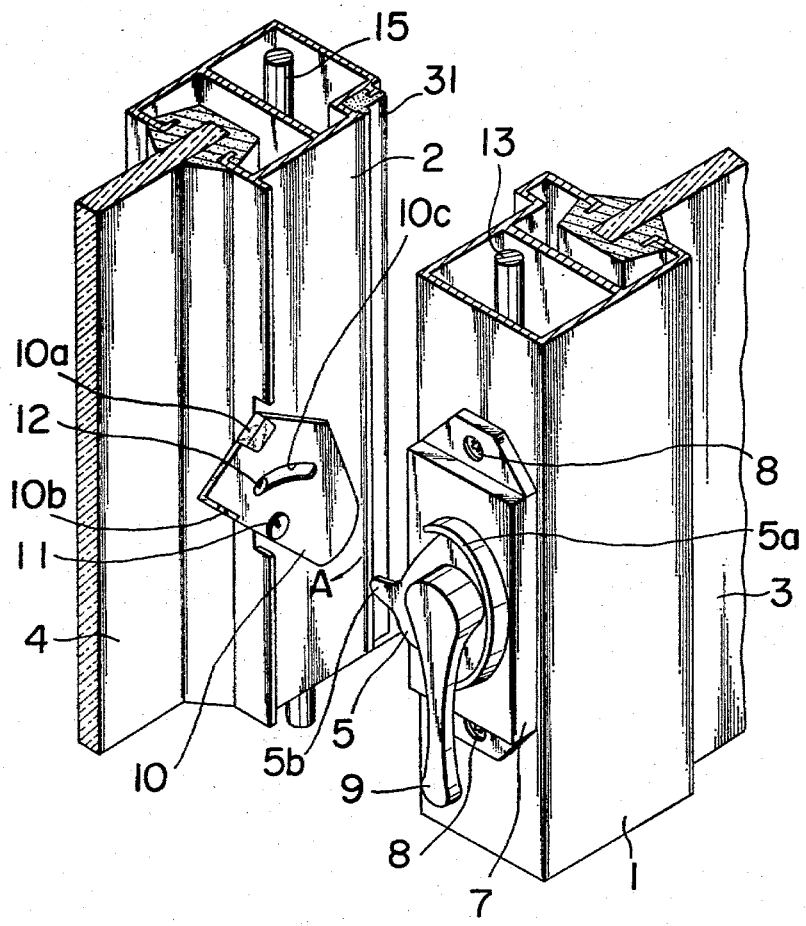
FIG. 1 is a perspective view of a preferred crescent fastening member with a handle and a receptacle member in accordance with the invention, showing the manner in which they are mounted on the meeting stiles of the inside sliding sash and the outside sliding sash, respectively.

In FIG. 1 showing a perspective view of the preferred locking mechanism, the stile 1 of the inside sash and stile 2 of the outside sash holding respective window panes 3 and 4 meet together when the double-sliding sashes are in the closed positions as shown in the figure. Each of the meeting stiles 1 and 2 is usually not solid but hollow in the form of something like an elongated box, as shown by the cross sections appearing in FIG. 1.

Figure 2:
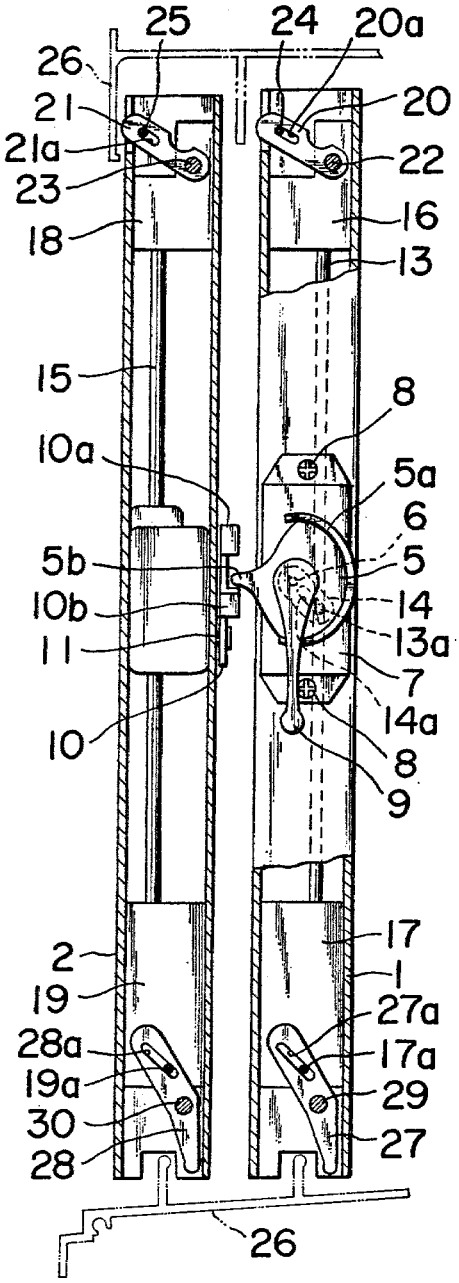
FIG. 2 is an elevational side view of the preferred locking mechanism partly broken as being mounted on the meeting stiles of the sliding sashes.

On the lateral face and at a middle height of the meeting stile 1 of the inside sash a crescent fastening member 5 is mounted with a pivot 6 (see FIG. 2) in a revolvable manner through a base plate 7 which is fastened directly to the meeting stile 1 with screws 8. The crescent fastening member 5 is in a form of partly broken circle (or part-circular), as shown in FIG. 2 illustrating the side view of the mechanism and provided with a raised flange **5*a* (hereinafter called a crescent) along its periphery. A handle 9 is provided at the center of the crescent fastening member 5 coaxially and integrally so that the crescent fastening member 5 is revolved by turning the handle 9 around the pivot 6. The crescent fastening member 5 is further provided with a projection 5***b* projecting in a radial direction opposite to the crescent 5*a*.

On the other hand, the meeting stile 2 of the outside sash is provided with a receptacle member 10 mounted on the inward face of the stile 2 by means of a pivot 11 in a revolvable manner. The receptacle member 10 is provided with a hooked part 10*a* as bent inwardly (see FIGS. 3 and 5) which comes into engagement with the end of the crescent 5*a* when the crescent fastening member 5 is revolved by turning the handle 9. The receptacle member 10 is further provided with a contact projection 10*b* also projecting inwardly, which is contacted and pushed by the pusher projection 5*b* of the crescent fastening member 5 when the crescent fastening member 5 is revolved by turning the handle 9 so that the receptacle member 10 is rotated around the pivot 11. The receptacle member 10 is always urged by a spring (not shown in the figures) in the direction shown by the arrow A but, when not in contact with the crescent fastening member 5, is held at the position shown in FIG. 1 by means of a limiting stopper 12 which appears in the arch-wise slot 10*c* of the receptacle member 10.

Within the hollow space of the meeting stile 1 of the inside sash, a first driving rod 13 is provided, extending in the vertical/longitudinal direction of the meeting stile 1 and being linked to the pivot 6 of the crescent fastening member 5 or the handle 9 so that the driving rod 13 can be moved up and down by turning the handle 9. The linking of the handle 9 and the driving rod 13 is obtained by means of a pin 13*a* on the driving rod 13 engaging a linear slot 14*a* in a locking lever 14, as shown in FIG. 2.

On the other hand, a similar driving rod 15 is provided in the hollow space of the meeting stile 2 of the outside sash and this second driving rod 15 is moved up and down by being linked to the receptacle member 10. The linking motion of the receptacle member 10 and the second driving rod 15 is obtained by means of a driving projection 10*d* on the receptacle member 10 extending into the hollow space of the meeting stile 2 through an arch-wise slot 2*a* and moved along the slot 2*a* when the receptacle member 10 is revolved around the pivot 11 (see FIGS. 3 to 6).

Each of the driving rods 13 (and 15) is connected at both of the upper and lower ends thereof to sliders 16 and 17 (18 and 19), respectively, which can slide smoothly within the meeting stile 1 (2) to guide the vertical movements of the driving rods 13 (15). The upper sliders 16 (18) are each provided with a locking lever 20 (21) pivotally supported with a pivot 22 (23), respectively. The locking levers 20 (21) are each provided with a linear slot 20*a* (21*a*) which is engaged with a pin 24 (25) fixed to the meeting stile 1 (2) so that the upward movement of the sliders 16 (18) result in projecting the locking levers 20 (21) outwardly bringing the end points of the locking levers 20 (21) into contact with the side walls of a frame 26 to push the frame 26 outwardly. As a reaction of this pushing, the sashes are pulled inwardly, i.e., toward the room.

On the other hand, the lower sliders 17 and 19 are each provided with a pin 17*a* (19*a*) which is engaged with the linear slot 27*a* (28*a*) provided in a locking lever 27 (28), which in turn is supported with a pivot 29 (30) in a manner capable of free rotation therearound. Thus, the locking levers 27 (28) are revolved by the vertical movement of the driving rods 13 (15) and, in particular, revolved clockwise in FIG. 2 when the driving rods 13 (15) are moved upwardly by turning the handle 9 and revolving of the receptacle member 10 so that the other ends, i.e. opposite ends to the linear slots 27*a* (28*a*), come into contact with the side walls of the guide rails of the frame 26 to push them. Consequently, the meeting stiles 1 and 2 are pulled inwardly as a reaction of pushing also at the lower ends thereof.

The interrelated movements of the crescent fastening member 5 and the receptacle member 10 are now described in further detail with reference to FIGS. 3 to 6.

Figure 3:
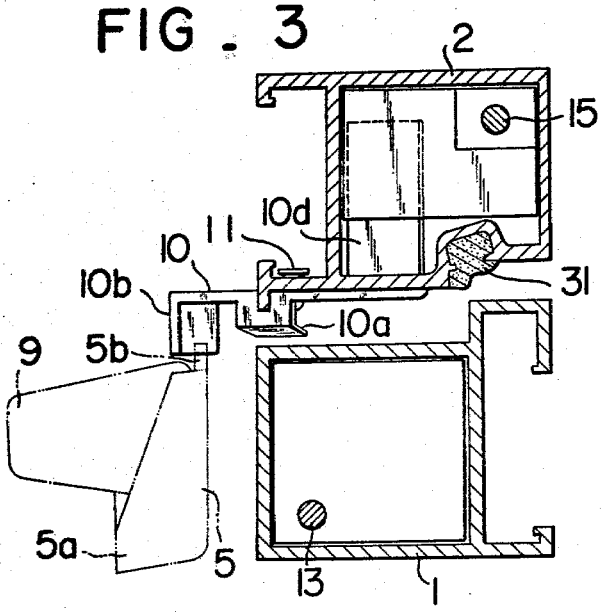
FIG. 3 is an enlarged cross sectional view along the line III—III in FIG. 2 or FIG. 4 showing the crescent fastening member and the receptacle member in the unfastened positions.
Figure 4:
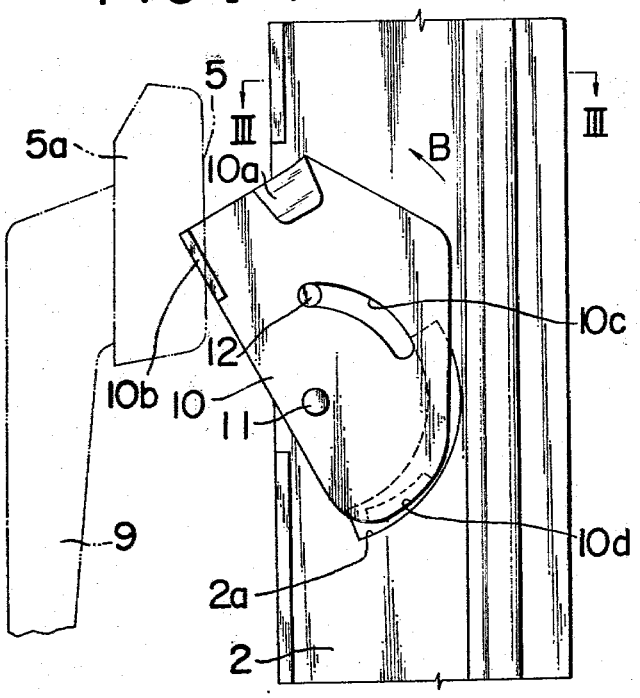
FIG. 4 is an enlarged elevational side view showing the mounting relationship of the receptacle member, unfastened, to the crescent fastening member with the meeting stile of the inside sliding sash removed.

FIG. 4 is a side view (omitting the stile 1) showing the receptacle member 10 mounted on the stile 2 of the outside sash when it is not engaged by the crescent fastening member 5. FIG. 3 is a cross section along the line III—III in FIG. 4 with the meeting stile 1 added. When the handle 9 is turned, the pusher projection 5*b* first engages the contact projection 10*b* of the receptacle member 10 and, by further turning of the handle 9, the receptacle member 10 is revolved around the pivot 11 in the direction shown by the arrow B being pushed by the pusher projection 5*b* in contact with the projection 10*b*, downwardly counteracting the resilience of the spring (not shown in figures) which urges the receptacle member 10 in the direction shown by arrow A in FIG. 1. In the revolving of the receptacle member 10, the limiting stopper 12 slides along the archwise slot 10*c* provided in the receptacle member 10, limiting the revolving of the receptacle member 10 at the position shown in FIG. 6, and also the driving projection 10*d* extending into the arch-wise slot 2*a* provided in the stile 2 slides along the slot 2*a*.

Figure 5:
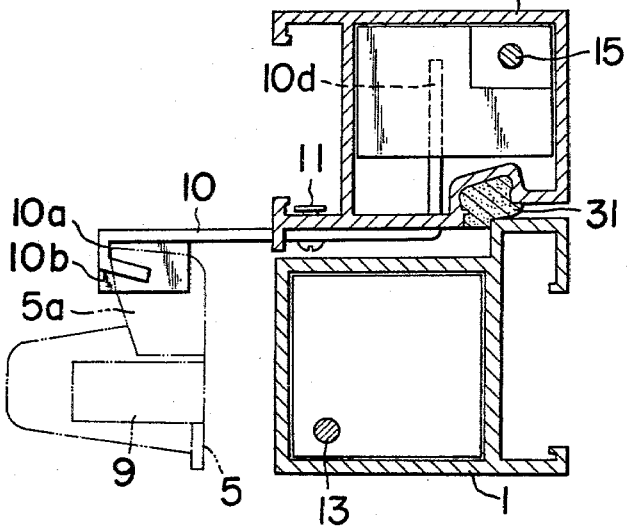
FIG. 5 is an enlarged cross sectional view along the line V—V in FIG. 6 showing the crescent fastening member and the receptacle member in the fastened positions.

Directly before the pusher projection 5*b* is disengaged from the contact projection 10*b*, the advancing end of the crescent 5*a* becomes engaged with the hooked part 10*a* of the receptacle member 10 whereby the crescent fastening member 5 and the receptacle member 10 are engaged and pulled to each other, and the air- and water-tightness between the meeting stiles 1 and 2 is ensured by virtue of the caulking material 31, as shown in FIG. 5.

Needless to say, the driving rods 13 and 15 are moved upwardly in this case, being driven respectively by the turning of the handle 9 or by means of the driving projection 10*d* extending into the meeting stile 2 so that the inside and the outside sashes are integrally pushed to the window frame 26 by means of the locking levers 20, 21, 27 and 28.

Figure 6:
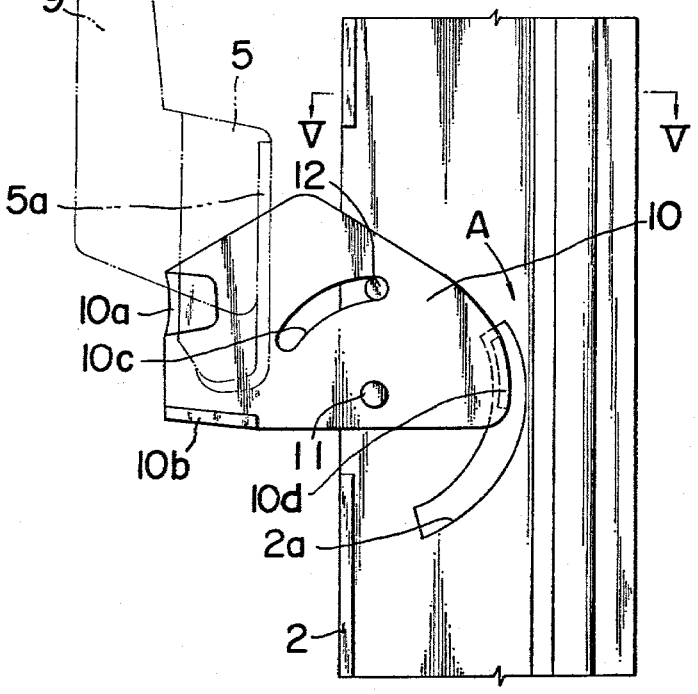
FIG. 6 is an enlarged elevational side view showing the mounting relationship of the receptacle member fastened to the crescent fastening member with the meeting stile of the inside sliding sash removed.

When the locking mechanism in the locked condition as shown in FIGS. 5 and 6 is to be unlocked, the handle 9 is turned in the reverse direction so that the end of the crescent 5*a* and the hooked part 10*a* of the receptacle member 10 are disengaged from each other with simultaneous downward movement of the driving rod 13 in the meeting stile 1 and releasing of the locking levers 20 and 27 from pressing against the window frame 26 to permit free sliding of the inside sliding sash within the window frame 26. When the receptacle member 10 is unfastened from the crescent fastening member 5, the receptacle member 10 is revolved freely around the pivot 11 in the direction shown by the arrow A by virtue of the spring means (not shown) until the movement is stopped by the limiting stopper 12 sliding in the arch-wise slot 10*c*. By this revolving of the receptacle member 10 in the reverse direction shown by the arrow A, the driving rod 15 provided in the meeting stile 2 is also moved downwardly so that the locking lever 21 and 28 are released from pressing against the window frame 26 to permit free sliding of the outside sliding sash within the window frame 26.

As is understood from the description above given, the fastening of the inside and the outside sliding sashes and the securing of the thus fastened sashes to the window frame can be simultaneously effected by the single operation of the handle alone, so that the advantages obtained by the inventive locking mechanism are very great, especially in stormy weather.

What is claimed is:

1. A mechanism for locking a dual sash window assembly in which a pair of sliding sashes are mounted in parallel, closely spaced planes within a supporting frame for relative horizontal sliding along the sliding frame, which comprises (a) a crescent fastening member mounted on the lateral face of the meeting stile of the inside sash in a manner capable of being revolved pivotally by a handle, said crescent fastening member being provided with a pusher projection in the radial direction opposite to the crescent of the crescent fastening member, (b) a receptacle member mounted on the inward face of the meeting stile of the outside sash in a manner capable of being revolved pivotally, said receptacle member being provided with a hooked part bent inwardly and coming into engagement with the crescent of the crescent fastening member when the crescent fastening member is pivotally revolved and being provided with a contact projection coming into contact with the pusher projection of the crescent fastening member and pushed by the contact projection when the crescent fastening member is pivotally revolved so that the receptacle member is revolved pivotally, (c) a driving rod provided in the meeting stile of the outside sash and linked with the receptacle member and moved up and down by the revolving of the receptacle member, and (d) locking levers each being linked with the driving rod at the upper or lower end thereof and revolvable by the up-and-down movement of the driving rod to push the side walls of the supporting frame each at one end thereof or come apart from the side walls of the supporting frame.

2. A mechanism as claimed in claim 1 wherein the receptacle member is always urged by a spring means in the direction counteracting the pushing by the pusher projection of the crescent fastening member.

3. A mechanism as claimed in claim 1 or 2 wherein a second driving rod is provided in the meeting stile of the inside sash and linked with the crescent fastening member and moved up and down by the pivotal revolving of the crescent fastening member and locking levers are provided, linked with the upper and lower ends of said second driving rod in a manner capable of being revolved by the up-and-down movement of the second driving rod to push the side walls of the supporting frame each at one end thereof or come apart from the side walls of the supporting frame.

* * * * *